US006461163B1

(12) United States Patent
Gallagher et al.

(10) Patent No.: US 6,461,163 B1
(45) Date of Patent: Oct. 8, 2002

(54) SPORT CLUB SWING TRAINER ARRANGEMENT

(76) Inventors: Michael A. Gallagher, 79 W. Park Dr., Wakefield, MA (US) 01880; Michael J. Hope, 24 Puddingstone La., Medway, MA (US) 02053

( * ) Notice: Subject to any disclaimer, the term of this patent is extended or adjusted under 35 U.S.C. 154(b) by 0 days.

(21) Appl. No.: 09/735,011

(22) Filed: Dec. 12, 2000

(51) Int. Cl.[7] ..... A63B 69/36
(52) U.S. Cl. ..... 434/252; 473/233; 473/234
(58) Field of Search ..... 434/247, 252; 473/219, 226, 230, 231, 257, 237, 461, 224, 234, 256, 333

(56) References Cited

U.S. PATENT DOCUMENTS

| | | | | |
|---|---|---|---|---|
| 2,135,648 | * | 11/1938 | Stumpf | 473/233 |
| 2,950,115 | * | 8/1960 | Hurdzan | 473/234 |
| 3,498,616 | * | 3/1970 | Hurst | 473/234 |
| 4,027,886 | * | 6/1977 | Katsube | 273/456 |
| 5,711,718 | * | 1/1998 | Mueller | 473/234 |
| 5,776,006 | * | 7/1998 | Gruber | 403/344 |

* cited by examiner

*Primary Examiner*—Kien T. Nguyen
(74) *Attorney, Agent, or Firm*—Don Halgren

(57) ABSTRACT

The present invention covers a swing trainer arrangement for providing recognizable signals to the user/holder of a sports club or racket to indicate the optimum swing and strike locations during playing with a ball or puck. The swing trainer arrangement comprises a first stopper and a second stopper each may be adjustably arranged to be supported at a selected location of a shaft or handle of the sports club or racket. At least one movable member is arranged to be slideably disposed between the first and second stoppers to generate a signal when they hit one another of a stopper as to indicate certain preferred arcuate swing locations of the shaft or handle during such play thereof, or indicate to the user as to inaccuracies of that swing when a sound is produced before or after the club swings through an optimum location for hitting a ball, puck or the like.

16 Claims, 4 Drawing Sheets

SPORT CLUB SWING TRAINER ARRANGEMENT

BACKGROUND OF THE INVENTION

1. Field of the Invention

This invention relates to a swing training device for golf clubs, tennis rackets, baseball bats, or the like, which permits a user to audibly realize the proper timing of the swing.

2. Prior Art

Popular sports such as golf, baseball, hockey and tennis require the holding and swinging of a shaft (which may be a club, racket or stick) to hit an object such as a ball or a puck to drive the ball or puck in a proper desired direction. The swinging of that club, be it a baseball bat, golf club, hockey stick or tennis racket requires skill and a lot of practice, over a long period of time, in order to do it properly. One of the disadvantages of playing these particular sports is that the swing of a club or the shaft occurs so fast, that it is almost impossible to figure out how you did it improperly unless you watched yourself through a slow motion camera.

There are some shaft or club training arrangements known in the field, to help sportsmen play the game, however they may be somewhat cumbersome and don't often teach the user the proper timing and swing by results other than the travelling performance of the ball or puck. The first is shown in U.S. Pat. No. 4,819,935 to Dirksing et al, which shows a ballast on the stem of a baseball bat, which ballast is adjustable along the length of the bat.

U.S. Pat. No. 5,133,551 to Handy et al. shows a novelty bat having a sound-producing slide weight within a center bore of the bat to make a sound effect.

U.S. Pat. No. 5,360,209 to Mollica shows a baseball bat training device with a weighted member which slides along the rod of the bat, to provide a visual indication to the batter as to when acceleration is made during the swing.

U.S. Pat. No. 5,836,829 to Van Cott et al. shows a golf-swing training device in which an audible sound is produced by an integrated circuit chip arranged within the club head. Improper swinging of the club indicates through the electronic chip by a particular noise and hence indicates a problem with the swing.

U.S. Pat. No. 5,860,873 to Karasabas shows a golf swing trainer arrangement with a tubular chamber running transversely to the shaft of the club, the chamber being divided and having a movable ball therewithin. Movement of the ball between the chambers of the housing arranged transversely on the shaft indicates an improper swing.

While these arrangements are somewhat novel, they are in most cases unduly complicated and don't necessarily indicate the proper timing of the swing for the proper impact to occur between the club or racket and the ball or puck.

It is an object of the present invention to overcome the disadvantages of the prior art.

It is a further object of the present invention, to provide a simple and economical teaching aide for the swinging of a club or racket to indicate both initial and vital stages of a swing thereof.

It is still yet a further object of the present invention to provide a series of audible or visual responses to indicate to the user of proper swinging characteristics.

It is still yet another further object of the present invention to provide a swing trainer device which may be adjustable to accommodate the size or the swing conditions of the sports player.

BRIEF SUMMARY OF THE INVENTION

The present invention comprises a swing trainer arrangement, which is adaptable onto the shaft of a sport club such as a golf club, a hockey stick, a tennis racket, or a baseball bat or the like.

The swing trainer arrangement, in the first preferred embodiment, comprises an elongated linear rod, which may be arranged within the elongated shaft of the sport club, racket or stick being utilized. The rod is elongated, and has a first or lower end and a second or upper end. A stopper is preferably adjustably secured by a set screw or the like to the first or lower end of the rod, and a second stopper is securably arranged by a set screw, welding or the like, on the upper or second end of the rod. In this first preferred embodiment, a pair of rings, preferably metal, are slideably disposed on the rod between the first and second stoppers within the shaft of the club/racket/stick. The rod is internal within the shaft of the club or stick or racket handle being utilized by the player, and when the shaft is swung into its preliminary orientation just prior to the swing to hit the ball or puck, the two rings strike one another at the proximal or hand-held end of the shaft. During the arcuate swinging motion of the shaft by the player, the rings are caused to slide down the rod within the shaft and strike one another at the point of the swing which is optimum for striking the ball or puck, thus providing an audible signal to the player as to where and when in the arc of the swing that ball or puck should be hit, that is, simultaneously with the audible sound of the rings within that shaft. It is to be noted that if the sound occurs before the optimum location "of the hit then the user will know that the swing of the club, bat etc. was released to early, the sound of the movable member(s) resonating before the optimum location was reached by the club, bat etc. The obverse is also true for this invention.

In a further preferred embodiment of the present invention, the first and second stoppers may be placed externally about the lower and upper ends of the shaft of the club being played, so as to permit the swing trainer arrangement to be readily adapted to a standard shaft, game, club, or bat, and indicate to the user by both audible and visual signals.

In yet a further embodiment of the present invention, the elongated rod is replaced by a tubular member, the tubular member having a stopper adjustably arranged within each end thereof, and metal blocks or balls within that bore of the tubular member to effect the sound patterns at the beginning and at the optimum impact at the swing of the shaft containing that tubular member. I such sound occurs at a different time than at the point of impact of the club, bat etc. with the ball of puck, the user may then be able to recognize his/her inaccuracies, and adjust his/her swing accordingly.

In yet a still further preferred embodiment of the present invention, the swing trainer arrangement may be provided in kit form, wherein the stoppers are comprised of split rings, having a hinge on one side thereof and a securing component on the other diametrically opposed edge, to provide the effective adjustable stop locations on the club or stick shaft. A pair of rings having an inside diameter sufficient to fit over the end of the club or stick, yet small enough to be stopped by the stoppers, may be fit over the end of the shaft to provide the audible (and visual) effect at the respective "swing-initiation" location and "swing-strike" location of the club, stick, bat, or racket.

Thus there has been shown a novel swing trainer apparatus which may be built into a golf club, tennis racket, hockey stick or baseball bat, or added onto an existing golf club, tennis racket, hockey stick or baseball bat or the like, to provide audible and visible indicia of proper (or improper) timing of the swing of a sports club to teach and thus to indicate the initial and the optimum locations for the ball/puck "strike-zones" for that club, stick, racket or bat.

The invention thus comprises a swing trainer arrangement for providing recognizable signals to the user/holder of a sports club or racket to teach the proper swing and ultimately indicate the optimum swing and strike locations. The arrangement may comprise: a first stopper and a second stopper each arranged to be supported at a selected location of a shaft or handle of the sports club or racket; and at least one movable member arranged to be slideably disposed between the first and the second stoppers to generate a signal as to certain preferred locations of the shaft or handle during play thereof. The first and second stoppers may be arranged internally in the shaft or handle of the sports racket or club. The first and second stoppers may be arranged externally on the shaft or handle of the sports racket or club. The first and/or second stoppers may be adjustable with respect to the longitudinal axis of the shaft or handle of the sports racket or club. The first and second stoppers may be threadably adjustable to a proper longitudinal location of the shaft or handle of the club or racket. The first and second stoppers may be securably locatable at a proper longitudinal location of the shaft or handle of the club or racket by a set screw arranged therewith. Each movable member may be comprised of a torroidally shaped ring, a planar washer, or a ball or combination thereof. The first and second stoppers may be arranged on a central rod of shaft arranged within the shaft or handle of the club or racket. The first and second stoppers may be arranged in a bore of a tubular member which is insertable into a shaft or handle of the club or racket. The sports club or racket may be selected from the group comprised of a tennis racket, a golf club, a hockey stick or a baseball bat. The signal may be audible. The signal may be visual. The signal may be both audible and visual.

The invention also may include a method of indicating the proper swing location of a sports club or racket comprising the steps of: providing at least one adjustable stopper at a specific location on or in a handle of the sports club or racket; placing at least one movable member between the stoppers in a sliding relationship therewith and the handle of the club or racket; swinging the club or racket so as to move a movable member with respect thereto; and signaling the proper location of the club or racket by the members hitting one another and/or at least one of the stoppers.

BRIEF DESCRIPTIONS OF THE DRAWINGS

The objects and advantages of the present invention will become more apparent when viewed in conjunction with the following drawings, in which:

FIG. 3 is a view of a further embodiment of the present invention showing hollow tubular members movable therewithin.

DETAILED DESCRIPTION OF THE PREFERRED EMBODIMENTS

Figure 1:
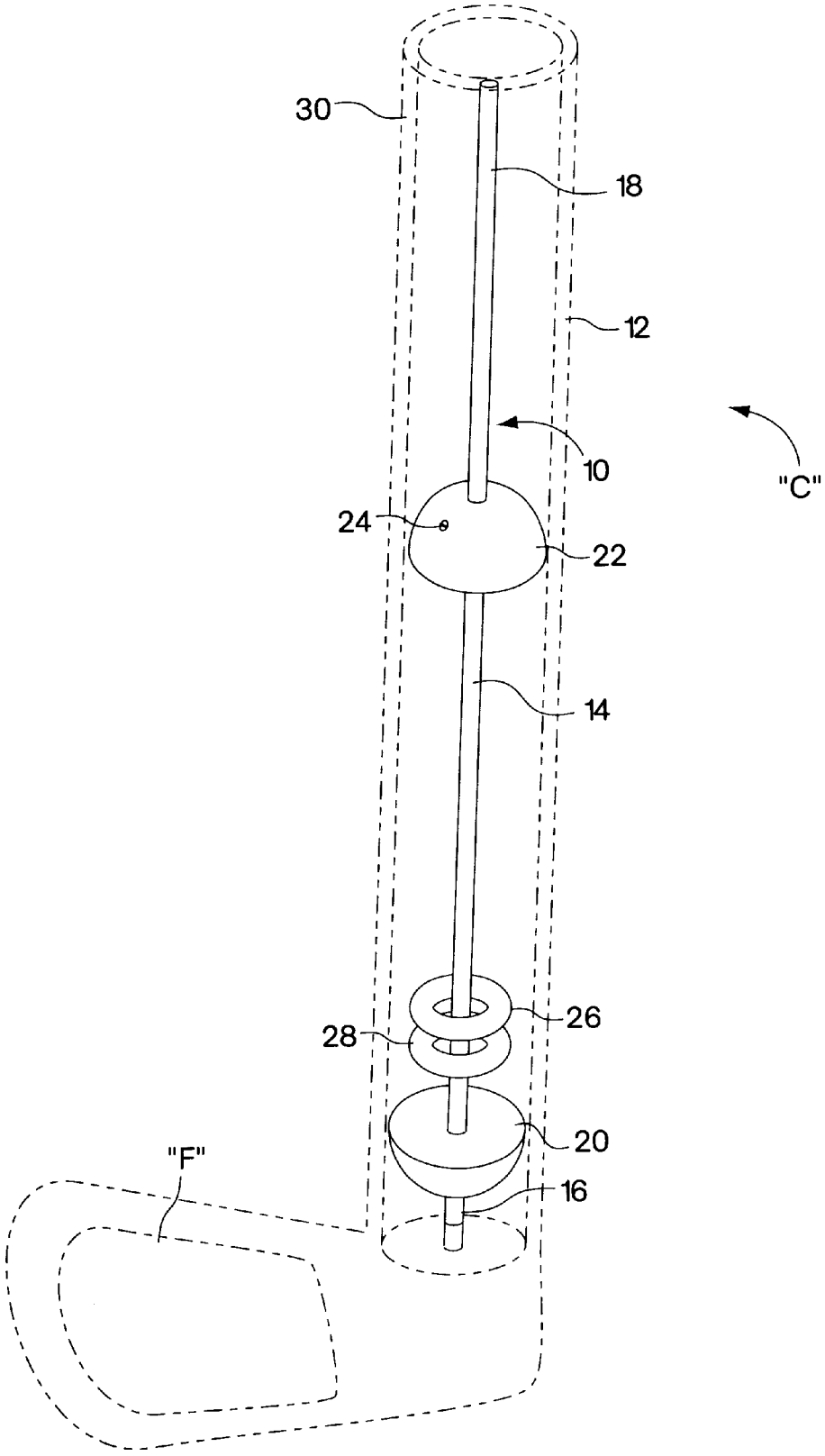
FIG. 1 is a side elevational view of the basic components of a swing trainer arrangement for adaptation in a club, bat racket or stick.

Referring now to the drawings in detail, and particularly to FIG. 1, there is shown the present invention which comprises a swing trainer arrangement 10, which is adaptable onto or within the shaft 12 of a club "C" such as a golf club, a hockey stick, a tennis racket, or a baseball bat or the like.

Figure 2:
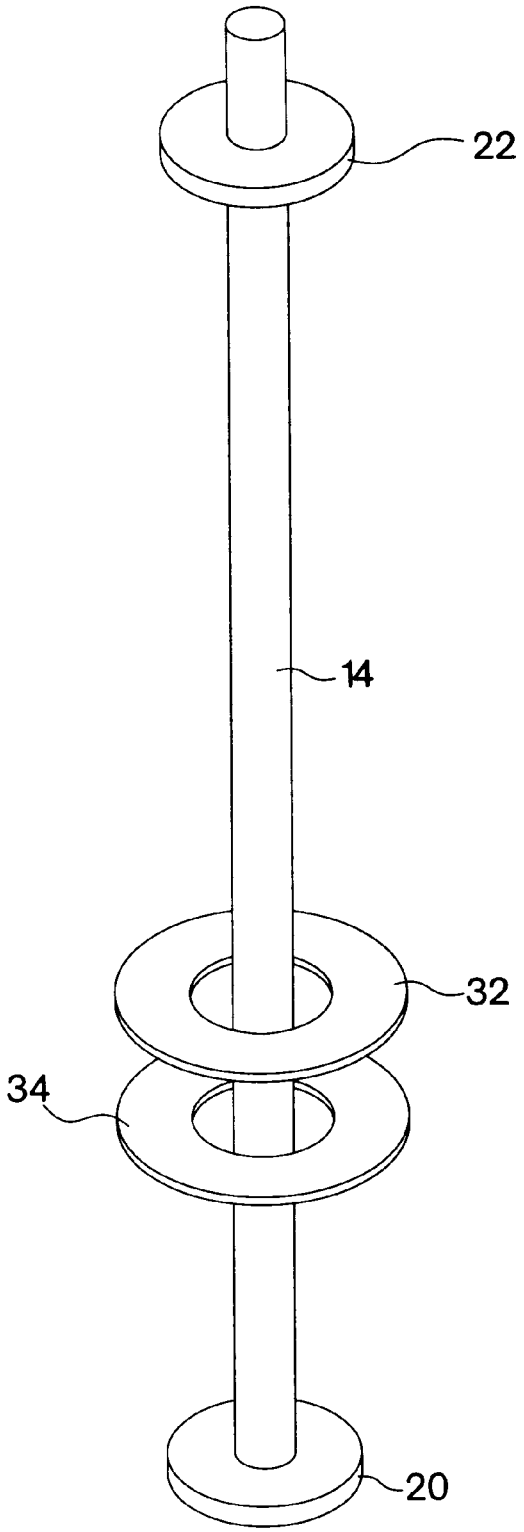
FIGS. 2 and 3 are views similar to FIG. 1, showing further embodiments of the present invention.

The swing trainer arrangement 10, in the first preferred embodiment as shown in FIG. 1, comprises an elongated linear rod 14 which may be arranged within the elongated shaft 12 of the sport club, racket or stick "C" being utilized. The rod 14 is elongated, and has a first or lower end 16 and a second or upper end 18. A first stopper 20 is preferably adjustably secured to the first or lower end 16 of the rod 14, and a second stopper 22 may be similarly adjustably and securably arranged on the upper or second end 18 of the rod 14. The adjustability may be accomplished by a threaded arrangement with respect to the stoppers 20 and 22 and the rod 14, or a set screw 24 or the like arranged within the stoppers 20 and 22. In this first preferred embodiment as shown in FIG. 1, at least one ring 25, or alternatively a pair of rings 26 and 28, (torroidally shaped to minimize the likelihood of jamming or sticking), and preferably constructed of metal, are slideably disposed on the rod 14 between the first and second stoppers 20 and 22 and within the hollow shaft 12 of the club/racket/stick "C". The rings may be of planar configuration, as shown in FIG. 2, wherein the rings may be configured as washers 32 and 34. In either embodiment, the rod 14 is thus internal within the shaft 12 of the club or stick or racket "C" being utilized by the player. When the shaft 12 of the club/stick/racket "C" is swung into its preliminary orientation just prior to the swing to hit the ball or puck, the two rings 26 and 28 strike one another at the proximal or handheld end 30 of the shaft 12. During the arcuate swinging motion of the shaft 12 by the player, the rings 26 and 28 are caused to slide down the rod 14 within the shaft 12 and strike one another at the point of the swing which is optimum for striking the ball or puck, thus providing an audible signal to the player as to where and when that ball or puck should be hit by the face "F" during the swing of the club "C", that is, simultaneously with the audible sound of the rings 26 and 28 within that shaft 12.

Figure 3:
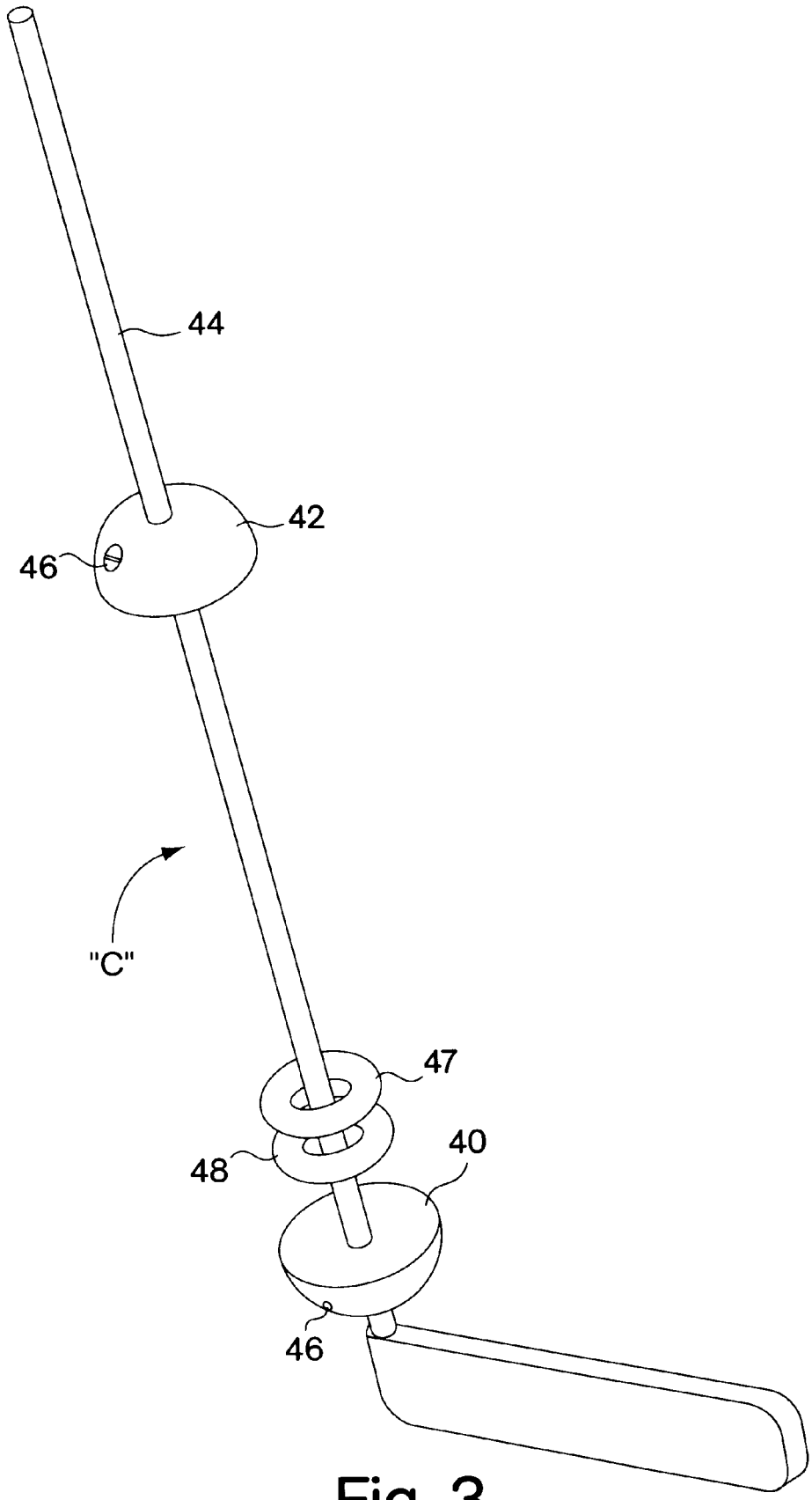

In a further preferred embodiment of the present invention as shown in FIG. 3, an axially adjustable arrangement of first and second stoppers 40 and 42 may be placed externally about the lower and upper ends of the shaft (handle) 44 of the club "C" being played, so as to permit the swing trainer arrangement 10 to be readily adapted to a standard shaft 44, handle of a club, or bat, and indicate to the user swing strike-optimization by both audible and visual signals. The rings 46 and 48 may readily slide "up and down" (along) the shaft 44, making audible signals when they strike one another or their respective stoppers 40 and 42. Such stoppers 40 and 42 may be adjustably mounted on the handle/shaft 44 of the club/racket "C" by set screws 46 or the like.

Figure 4:
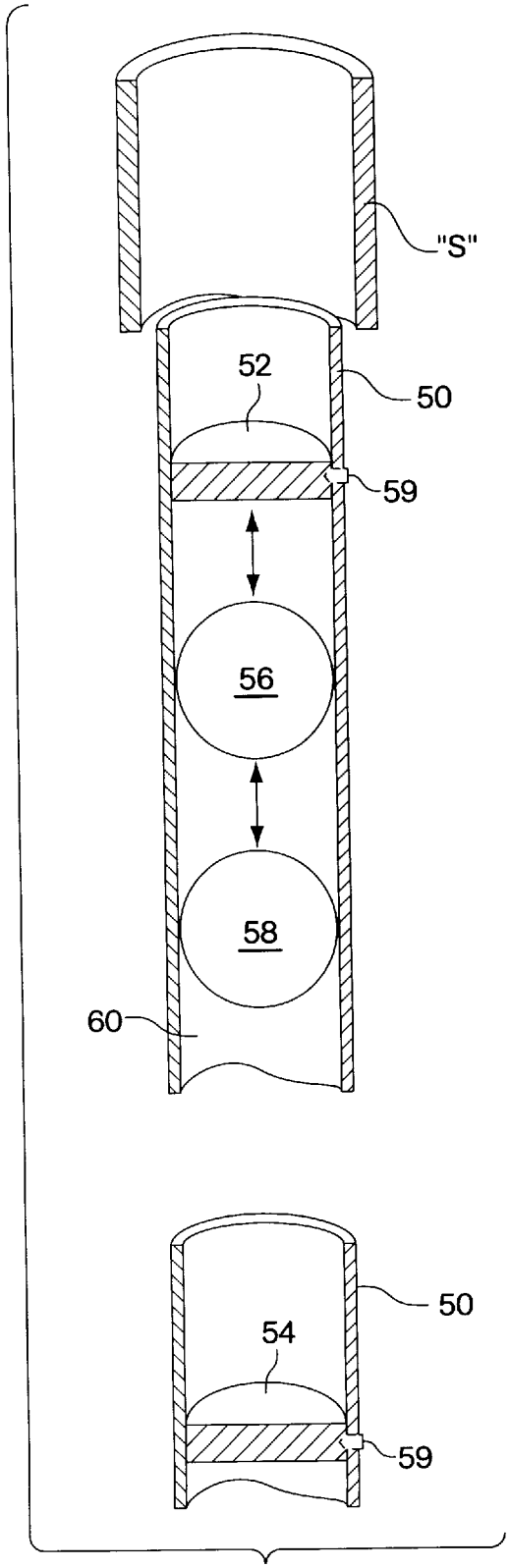
FIG. 4 perspective view of the present invention shown as a kit for retrofitting an existing baseball bat, golf club, tennis racket or hockey stick.

In yet a further embodiment of the present invention as shown in section in FIG. 4, the elongated rod is replaced with a tubular member 50, the tubular member 50 having a pair of stoppers 52 and 54 adjustably, by set screws 59 or the like, the stoppers 52 and 54 arrangeable at end thereof, and a pair of metal blocks or balls 56 and 58 slideably arranged within that bore 60 of the tubular member 50 to effect the sound signals at the beginning and at the optimum impact at the swing of the shaft "S" containing that tubular member 50.

In yet a still further preferred embodiment of the present invention as shown in FIG. 5, the swing trainer arrangement 10 may be provided in kit form, wherein the stoppers are comprised of a pair of split rings 66 and 68. The rings 66 and 68 may have a hinge 70 on one side thereof and a securing clip component 72 on the other diametrically opposed edge, to provide the effective adjustable stop locations on the club handle or stick shaft. The kit swing trainer arrangement 10 preferably includes a pair of rings 74 and 76 having an inside diameter 78 sufficient to fit over the end of the club or stick "C", yet small enough to be stopped by the stoppers 66 and 68, and may be fit over the end of the shaft to provide the audible (and visual) effect at the respective "swing-initiation" location and "swing-strike" location of the club, stick, bat, or racket "C".

Thus there has been shown a novel swing trainer apparatus which may be built into a golf club, tennis racket, hockey stick or baseball bat, or added onto an existing golf club, tennis racket, hockey stick or baseball bat or the like, to provide audible and visible indicia of proper timing of the swing of a sports club to indicate the initial and the optimum locations for the ball/puck "strike-zones" for that club, stick, racket or bat.

It is to be noted that if the sound of the movable member(s) occurs prior to the club, racket, stick or bat reaching the understood "optimum location" of its arcuate swing, such swing was released too early (the sound of the movable member(s) resonating before the optimum location of the club etc. was reached. The opposite situation is also instructive, that is, if the sound of the movable member(s) occurs after the club, racket, stick or bat passes through the ideal "optimum location" for striking the ball or puck, the swing was initiated too late. Thus, by appreciating when the "sound" should occur, the user will be able to adjust his/her swing accordingly.

We claim:

1. A sports club swing trainer arrangement for providing recognizable signals to the user/holder of said sports club to indicate the optimum swing and strike locations, comprising:

a first stopper and a second stopper each arranged to be supported at a selected location of a shaft or handle of said sports club wherein said first and second stoppers are arranged internally in said shaft or handle of said sports club; and at least one movable member arranged to be slideably disposed between said first and second stoppers to generate a signal as to indicate certain preferred locations of said shaft or handle during play thereof.

2. The sports club swing trainer arrangement as recited in claim 1, wherein said first and second stoppers are adjustable with respect to the longitudinal axis of said shaft or handle of said sports club.

3. The sports club swing trainer arrangement as recited in claim 2, wherein said first and second stoppers are threadably adjustable to a proper longitudinal location of said shaft or handle of said club.

4. The sports club swing trainer arrangement as recited in claim 2, wherein said first and second stoppers and securably locatable at a proper longitudinal location of said shaft or handle of said club by a locking device arranged therewith.

5. The sports club swing trainer arrangement as recited in claim 1, wherein said at least one movable member is comprised of a pair of torroidally shaped rings.

6. The sports club swing trainer arrangement as recited in claim 1, wherein said at least one movable member is comprised of a pair of planar washers.

7. The sports club swing trainer arrangement as recited in claim 1, wherein said at least one movable member is comprised a pair of balls.

8. The sports club swing trainer arrangement as recited in claim 1, wherein said first and second stoppers are arranged on a central rod arranged within said shaft or handle of said club.

9. The sports club swing trainer arrangement as recited in claim 1, wherein said first and second stoppers are arranged in a bore of a tubular member which is insertable into a shaft or handle of said club.

10. The sports club swing trainer arrangement as recited in claim 1, wherein said sports club is selected from the group comprised of a tennis racket, a golf club, a hockey stick or a baseball bat.

11. The sports club swing trainer arrangement as recited in claim 1, wherein said signal generated by said arrangement is audible.

12. The sports club swing trainer arrangement as recited in claim 1, wherein said signal generated by said arrangement is visual.

13. The sports club swing trainer arrangement as recited in claim 1, wherein said signal by said arrangement is both audible and visual.

14. A method of indicating the proper swing location of a sports club comprising the steps of:

providing a pair of stoppers at spaced apart locations inside a handle of said sports club;

placing at least one movable members between said stoppers in a sliding relationship therewith and said handle of said club;

swinging said club so as to move said at least one movable member with respect thereto; and signaling said proper location of said club by said at least one member hitting at least one of said stoppers during its swing.

15. The method as recited in claim 14, including the step of:

adjusting the location of at least one of said stoppers with respect to said handle of said club.

16. A swing trainer arrangement for providing recognizable signals to the user/holder of a sports club to indicate the optimum swing and strike locations, comprising:

a first stopper and a second stopper each arranged to be supported at a selected location of a shaft within said sports club;

a pair of movable members arranged to be slideably disposed between said first and second stoppers to generate a signal as to certain preferred locations of said shaft during play thereof; wherein said first and second stoppers are arranged internally in said shaft of said sports club; and wherein said first and second stoppers are adjustable with respect to the longitudinal axis of said shaft of said sports racket or club.

* * * * *